US006227404B1

(12) United States Patent
Hellebuyck

(10) Patent No.: US 6,227,404 B1
(45) Date of Patent: May 8, 2001

(54) HOOD COVER INSERT

(76) Inventor: Robert L. Hellebuyck, 9198 Mericle Rd., Avoca, MI (US) 48006

( * ) Notice: Subject to any disclaimer, the term of this patent is extended or adjusted under 35 U.S.C. 154(b) by 0 days.

(21) Appl. No.: 09/675,184

(22) Filed: Sep. 29, 2000

(51) Int. Cl.[7] ..... B65D 1/40
(52) U.S. Cl. ..... 220/730; 220/724; 220/581
(58) Field of Search ..... 220/581, 730, 220/724, 725, 726, 727, 728; 43/107, 124, 132.1

(56) References Cited

U.S. PATENT DOCUMENTS

D. 360,820 8/1995 Haase .
3,372,836 3/1968 Smith .
4,645,091 2/1987 Madden et al. .
4,688,491 8/1987 Herrera et al. .
5,686,700 11/1997 Carpinella .
5,690,403 11/1997 Ellison et al. .

*Primary Examiner*—Stephen Castellano

(57) ABSTRACT

A hood cover insert for substantially filling the opening in a hood cover of a propane tank. The hood cover insert includes a block member having a base wall and a top wall. A perimeter wall extends between and is integrally coupled to the base and top walls. The base wall has an elongate slit extending upwardly therein. The block member comprises a resiliently flexible material. The block member is positioned in the opening of the hood cover such that the gas line is movably extended upwardly in the slit and the opening is substantially closed.

6 Claims, 1 Drawing Sheet

HOOD COVER INSERT

BACKGROUND OF THE INVENTION

1. Field of the Invention

The present invention relates to insert devices and more particularly pertains to a new hood cover insert for substantially filling the opening in a hood cover of a propane tank.

2. Description of the Prior Art

The use of insert devices is known in the prior art. More specifically, insert devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,688,491; U.S. Pat. No. 5,690,403; U.S. Pat. No. 5,686,700; U.S. Des. Pat. No. 360,820; U.S. Pat. No. 3,372,836; and U.S. Pat. No. 4,645,091.

While these devices fulfill their respective, particular objectives and requirements, the aforementioned patents do not disclose a new hood cover insert. The inventive device includes a block member having a base wall and a top wall. A perimeter wall extends between and is integrally coupled to the base and top walls. The base wall has an elongate slit extending upwardly therein. The block member comprises a resiliently flexible material. The block member is positioned in the opening of the hood cover such that the gas line is movably extended upwardly in the slit and the opening is substantially closed.

In these respects, the hood cover insert according to the present invention substantially departs from the conventional concepts and designs of the prior art, and in so doing provides an apparatus primarily developed for the purpose of substantially filling the opening in a hood cover of a propane tank.

SUMMARY OF THE INVENTION

In view of the foregoing disadvantages inherent in the known types of insert devices now present in the prior art, the present invention provides a new hood cover insert construction wherein the same can be utilized for substantially filling the opening in a hood cover of a propane tank.

The general purpose of the present invention, which will be described subsequently in greater detail, is to provide a new hood cover insert apparatus and method which has many of the advantages of the insert devices mentioned heretofore and many novel features that result in a new hood cover insert which is not anticipated, rendered obvious, suggested, or even implied by any of the prior art insert devices, either alone or in any combination thereof.

To attain this, the present invention generally comprises a block member having a base wall and a top wall. A perimeter wall extends between and is integrally coupled to the base and top walls. The base wall has an elongate slit extending upwardly therein. The block member comprises a resiliently flexible material. The block member is positioned in the opening of the hood cover such that the gas line is movably extended upwardly in the slit and the opening is substantially closed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hood cover insert apparatus and method which has many of the advantages of the insert devices mentioned heretofore and many novel features that result in a new hood cover insert which is not anticipated, rendered obvious, suggested, or even implied by any of the prior art insert devices, either alone or in any combination thereof.

It is another object of the present invention to provide a new hood cover insert which may be easily and efficiently manufactured and marketed.

It is a further object of the present invention to provide a new hood cover insert which is of a durable and reliable construction.

An even further object of the present invention is to provide a new hood cover insert which is susceptible of a low cost of manufacture with regard to both materials and labor, and which accordingly is then susceptible of low prices of sale to the consuming public, thereby making such hood cover insert economically available to the buying public.

Still yet another object of the present invention is to provide a new hood cover insert which provides in the apparatuses and methods of the prior art some of the advantages thereof, while simultaneously overcoming some of the disadvantages normally associated therewith.

Still another object of the present invention is to provide a new hood cover insert for substantially filling the opening in a hood cover of a propane tank.

Yet another object of the present invention is to provide a new hood cover insert which includes a block member having a base wall and a top wall. A perimeter wall extends between and is integrally coupled to the base and top walls. The base wall has an elongate slit extending upwardly therein. The block member comprises a resiliently flexible material. The block member is positioned in the opening of the hood cover such that the gas line is movably extended upwardly in the slit and the opening is substantially closed.

Still yet another object of the present invention is to provide a new hood cover insert that may be retrofitted to existing hood covers.

Even still another object of the present invention is to provide a new hood cover insert that substantially fills an opening in a hood cover so that insects and small animals may not inhabit the hood cover. Such insects and small animals may pose a threat to persons dealing with propane tanks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
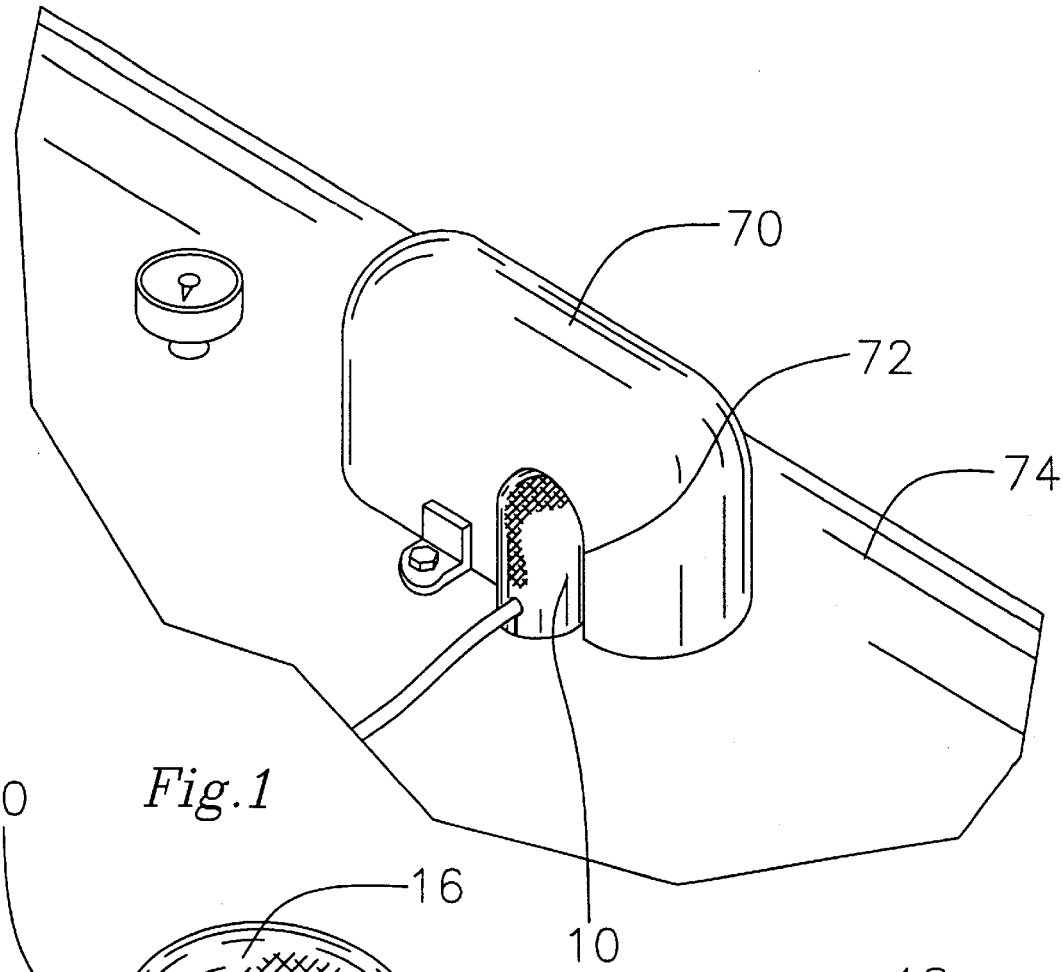
FIG. 1 is a schematic perspective in-use view of a new hood cover insert according to the present invention.
Figure 2:
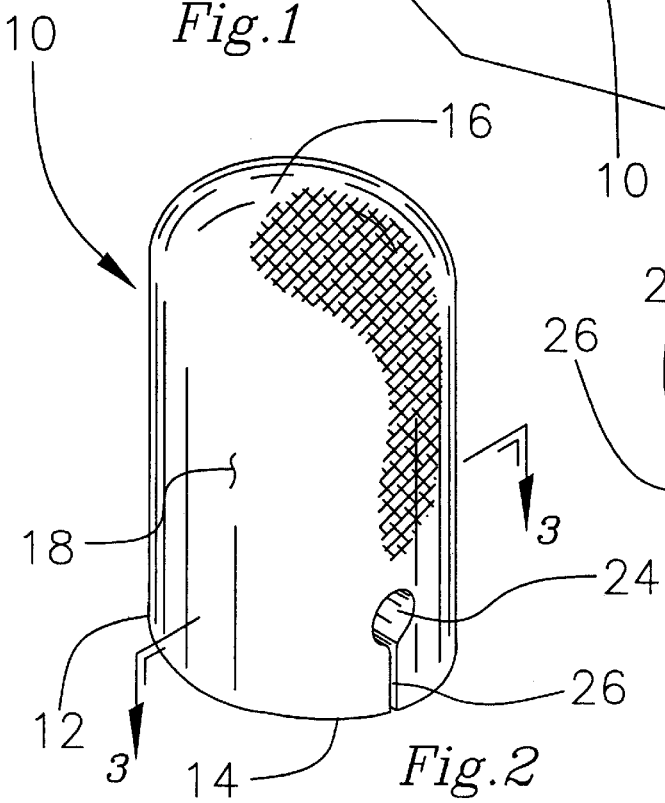
FIG. 2 is a schematic perspective view of the present invention.
Figure 3:
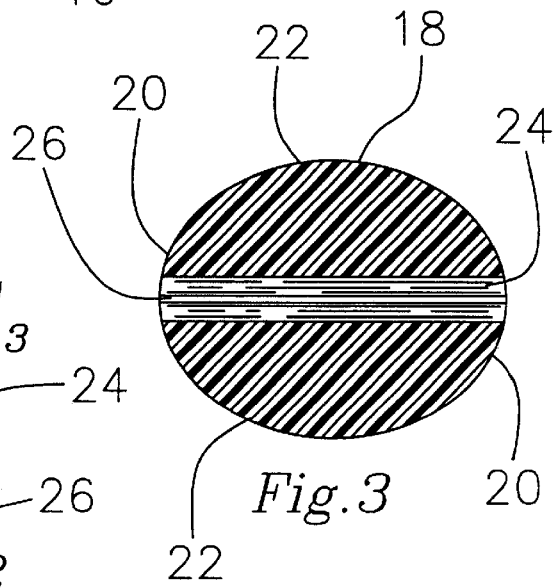
FIG. 3 is a schematic cross-sectional view taken along line 3—3 of the present invention.

With reference now to the drawings, and in particular to FIGS. 1 through 3 thereof, a new hood cover insert embodying the principles and concepts of the present invention and generally designated by the reference numeral 10 will be described.

As best illustrated in FIGS. 1 through 3, the hood cover insert 10 generally comprises a block member 12. The block member 12 has a base wall 14 and a top wall 16. A perimeter wall 18 extends between and is integrally coupled to the base 14 and top 16 walls. A cross-section of the block member 12, taken transversely to a line extending through the base 14 and top 16 walls, has a generally oval shape such that a first pair of opposite sides 20 are respectively more arcuate than a second pair of opposite sides 22. The block member 12 has a hole 24 extending therethrough. The hole 24 extends through the first pair 20 of opposite sides. A longitudinal axis of the hole 24 is orientated generally parallel to a plane of the base wall 14. The hole 24 is positioned generally nearer the base wall 14 than the top wall 16. The base wall 14 has an elongate slit 26 extending upwardly therein. A plane of the slit 26 generally extends through the hole 24. The elongate slit 26 extends between the first pair 20 of opposite sides and upwardly into the hole 24. The top wall 16 is generally convex shaped. The block member 14 has height generally between 2½ inches and 4 inches and preferably equal to 3¼ inches. A first diameter extending between said first sides 20 being generally between 2 inches and 4 inches and preferably equal to 3¼ inches. A second diameter extending between said second sides 22 being generally between 2 inches and 3 inches and ideally equal to 2½ inches. The block member 12 is comprised of a resiliently flexible material. The resiliently flexible material is ideally a foamed elastomeric material.

In use, the block member 12 is positioned in an opening 72 a hood cover 70 of a propane tank 74. The gas line 76 is movably extended upwardly through the slit 26 and removably positioned in the hole 24. The hood cover 70 is a conventional hood cover used on propane tanks 74. The block member 12 has a conventionally sized opening for passage of the gas line 72. The block member 12 prevents small animals and insects from entering the hood cover 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insert device for filling an opening in hood cover of a propane tank, a gas line extending outwardly out of said hood cover through said opening, said device comprising:

a block member, said block member having a base wall and a top wall, a perimeter wall extending between and being integrally coupled to said base and top walls, said base wall having an elongate slit extending upwardly therein, said block member comprising a resiliently flexible material; and wherein said block member is positioned in said opening in said hood cover such that said gas line is movably extended upwardly in said slit.

2. The insert device as in claim 1, wherein said block member further comprises:

a cross-section of said block member taken transversely to a line extending through said base and top walls having a generally oval shape such that a first pair of opposite sides are respectively more arcuate than a second pair of opposite sides, said elongate slit extending between said first pair of opposite sides and upwardly into said hole, said block member having height generally between 2½ inches and 4 inches, a first diameter generally between 2 inches and 4 inches and a second diameter generally between 2 inches and 3 inches.

3. The insert device as in claim 2, wherein said block member comprises:

said block member having a hole extending therethrough, said hole extending through said first pair of opposite sides, a longitudinal axis of said hole being orientated generally parallel to a plane of said base wall, said hole being positioned generally nearer said base wall than said top wall, said slit extending upwardly into said hole.

4. The insert device as in claim 1, wherein said block member comprises:

said block member having a hole extending therethrough, a longitudinal axis of said hole being orientated generally parallel to a plane of said base wall, said hole being positioned generally nearer said base wall than said top wall, a plane of said slit generally extending through said hole, said slit extending upwardly into said hole.

5. The insert device as in claim 1, wherein said top wall is generally convex.

6. An insert device for filling an opening in hood cover of a propane tank, a gas line extending outwardly out of said hood cover through said opening, said device comprising:

a block member, said block member having a base wall and a top wall, a perimeter wall extending between and being integrally coupled to said base and top walls, a cross-section of said block member taken transversely to a line extending through said base and top walls having a generally oval shape such that a first pair of opposite sides are respectively more arcuate than a second pair of opposite sides, said block member having a hole extending therethrough, said hole extending through said first pair of opposite sides, a longitudinal axis of said hole being orientated generally parallel to a plane of said base wall, said hole being positioned generally nearer said base wall than said top wall, said base wall having an elongate slit extending upwardly therein, a plane of said slit generally extending through said hole, said elongate slit extending between said first pair of opposite sides and upwardly into said hole, said top wall being generally convex shaped, said block member having height generally equal to 3¼ inches, a first diameter generally equal to 3¼ inches and a second diameter generally equal to 2½ inches, said block member comprising a resiliently flexible material, said resiliently flexible material comprising a foamed elastomeric material; and wherein said block member is positioned in said opening in said hood cover such that said gas line is movably extended upwardly through said slit and removably positioned in said hole.

* * * * *